US005850685A

United States Patent [19]

Wright et al.

[11] Patent Number: 5,850,685

[45] Date of Patent: Dec. 22, 1998

[54] MANUAL CYCLING MECHANISM FOR A MAGNETICALLY POWERED TERMINATING MACHINE

[75] Inventors: Donald William Wright, Felton; Michael Anthony Yeomans, Camp Hill; Michael David Strong, Mechanicsburg, all of Pa.

[73] Assignee: The Whitaker Corporation, Wilmington, Del.

[21] Appl. No.: 901,976

[22] Filed: Jul. 29, 1997

[51] Int. Cl.[6] ..... H01R 43/04; H01R 43/048

[52] U.S. Cl. ..... 29/751; 29/744; 29/753; 29/755; 29/863; 29/33 M; 72/430

[58] Field of Search ..... 29/751, 753, 755, 29/861, 863, 33 M, 744; 72/430, 444

[56] References Cited

U.S. PATENT DOCUMENTS

| | | | |
|---|---|---|---|
| 3,036,308 | 5/1962 | Demler | 72/430 |
| 3,180,121 | 4/1965 | Eley | 72/444 X |
| 3,293,732 | 12/1966 | Broske | 72/430 X |
| 3,347,398 | 10/1967 | Smith | 214/138 |
| 5,065,609 | 11/1991 | Dischler | 72/444 X |
| 5,245,904 | 9/1993 | Meyerle | 72/430 X |

*Primary Examiner*—Peter Vo
*Assistant Examiner*—Rick Kiltae Chang
*Attorney, Agent, or Firm*—Anton P. Ness

[57] ABSTRACT

A machine (10) for receiving and operating a terminal applicator (12) in the attaching of an electrical terminal (14) to a conductor includes a magnetic power unit (28) having a fixed electromagnet (30) attached to the frame (20) and a movable electromagnet (32) coupled to the terminal applicator (12). The machine includes a cycling mechanism (86) for manually moving the movable electromagnet (32) through the power and return strokes of the terminal applicator (12). The cycling mechanism (86) includes a lead screw (88) having a nut (102) in threaded engagement therewith that moves vertically when the lead screw is rotated. A latch (110) attached to the nut (102) pivots into an opening (112) in the periphery (114) of the movable electromagnet (32) when the lead screw is rotated in one direction (130). As the lead screw (88) is rotated further the latch (110) carries the movable electromagnet (32) downwardly through its power stroke. When the lead screw (88) is rotated in the opposite direction the latch (110) carries the movable electromagnet (32) upwardly through its return stroke. When the movable electromagnet (32) nears its upper most position during the return stroke the latch (110) pivots, out of the opening (112) and disengages the movable electromagnet (32).

12 Claims, 4 Drawing Sheets

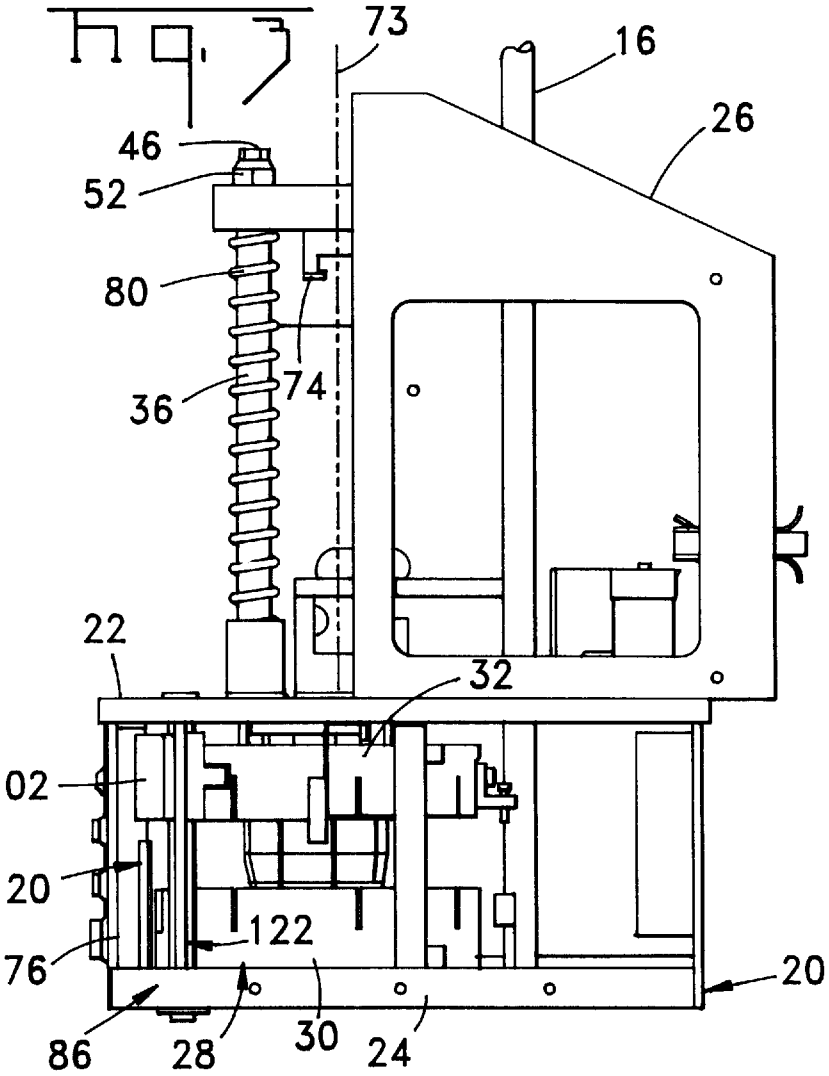
20
26
16
32
24
73
74
30
122
28
46
52
80
36
22
86
102
120
76
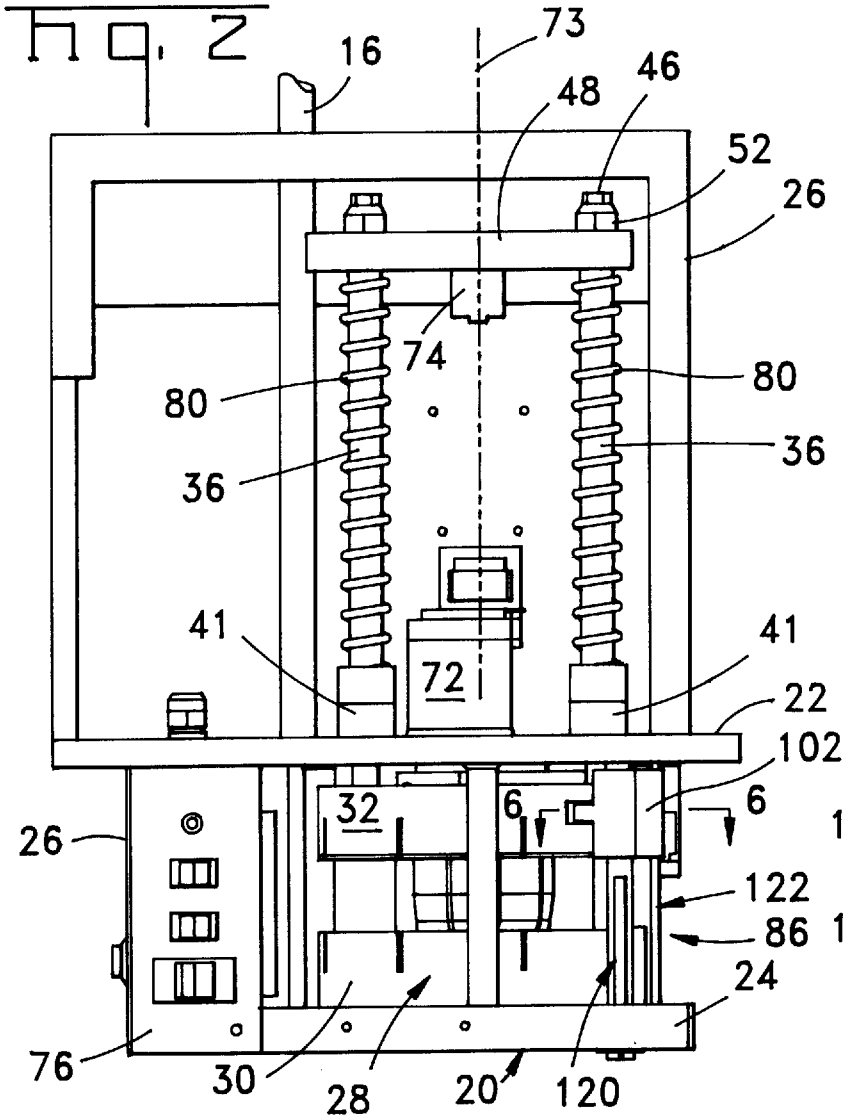
26
52
80
36
41
22
102
6
122
86
24
46
120
73
48
6
20
74
72
16
32
28
80
36
41
30
26
76

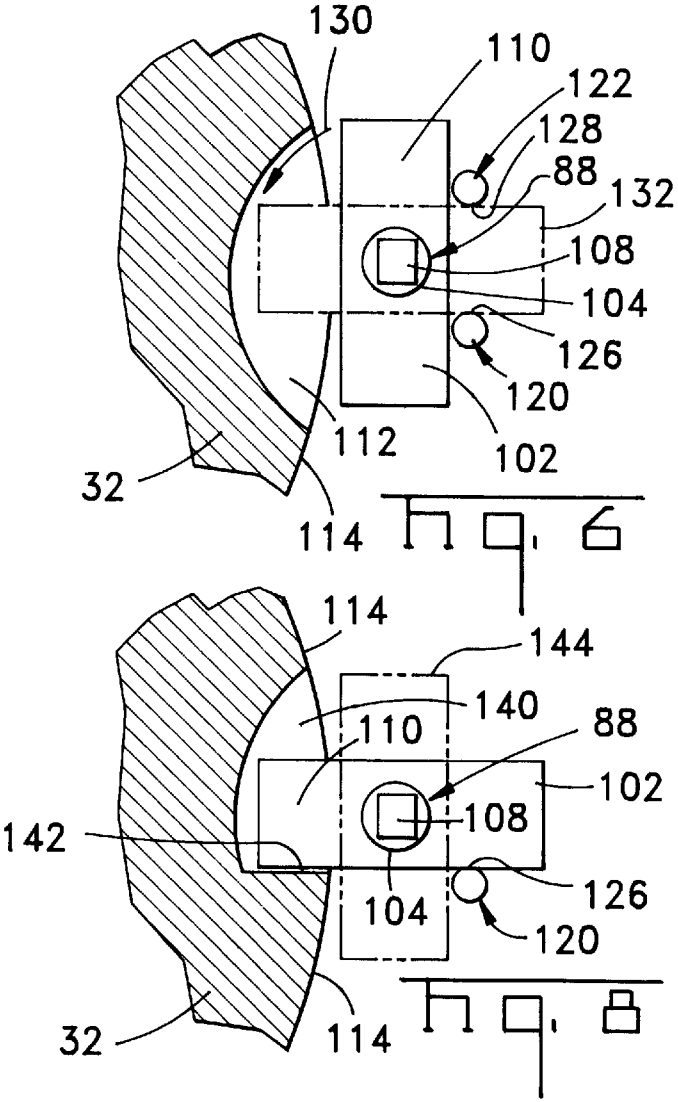
110
122
128
88
132
108
104
126
120
102
130
112
114
32
144
140
88
102
108
126
120
110
104
114
114
142
32
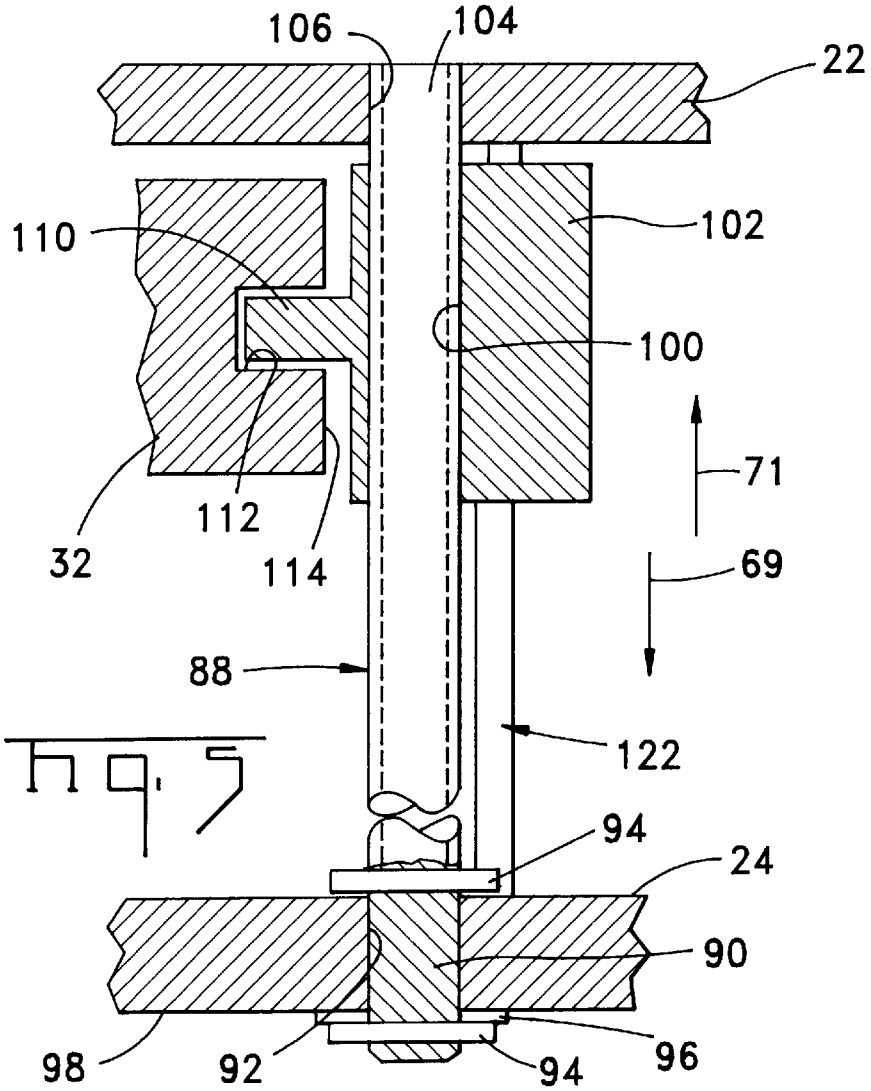
22
102
100
71
69
24
90
96
104
122
94
94
106
114
112
88
92
110
32
98

MANUAL CYCLING MECHANISM FOR A MAGNETICALLY POWERED TERMINATING MACHINE

The present invention relates to magnetically powered machines for attaching electrical terminals to conductors, and more particularly to such machines having a mechanism for manually cycling the ram through its full operational movement.

BACKGROUND OF THE INVENTION

Terminal applicators are commonly used in the electrical connector industry to attach terminals to electrical conductors. These terminal applicators are operated by means of a machine that provides the power to actuate the applicator ram and effect the crimping of the terminal onto the conductor. Such machines include a frame, a ram arranged to undergo reciprocating motion toward and away from a base plate, and a power source, such as an electric motor. The terminal applicator is secured to the base plate and the ram of the applicator is coupled to and carried by the ram of the machine. Typically, the electric motor is run continuously to drive a rotating flywheel which is coupled to a single revolution clutch mechanism that drives a crank coupled to the machine ram. When the clutch is tripped the machine ram is made to reciprocate one cycle. Such a machine is disclosed in U.S. Pat. No. 3,343,398. While this machine utilizes a moderately sized electric motor for power, it also requires a rather large and massive flywheel, crank, and clutch mechanism. These types of machines require that the machine crank and ram mechanism be strong and able to accommodate the high forces required to crimp a terminal onto a conductor. As a result, the mechanisms of these machines tend to be bulky and massive, and tend to undergo substantial wear during use. Because of the tendency for these machines to be bulky, the host machines that receive these machines must themselves be larger than would otherwise be necessary. To overcome this problem machines have been developed that utilize electro-magnets as a power source to actuate the machine ram. See, for example, U.S. patent applications Ser. No. 08/717,373 which was filed Sep. 20, 1996 entitled MAGNETIC PRESS and having attorney docket number 16776, and Provisional application Ser. No. 60/021,843 which was filed Jul. 16, 1996 entitled TWO STAGE PRESS and having attorney docket number 16662. Both of these applications are owned by the present assignee and disclose similar machines having an electromagnetic power unit for actuating the machine ram. The power unit has a fixed magnet that is attached to the frame of the machine and a movable magnet that is coupled to the machine's ram, which in turn is coupled to the ram of the terminal applicator. In the case of the '843 application, the movable magnet, when energized, moves toward the fixed magnet along a straight path, compressing a pair of rather strong return springs on its way. As movement continues, the applicator tooling engages and performs the crimping operation. The current to the magnets is removed and the return springs return the movable magnet to its starting position. During setup of such machines it is necessary to manually cycle the machine ram so that the operator can set the various adjustments of both the machine and the applicator and assure that the rams can properly move through their entire power and return strokes. Such cycling is relatively easy to perform on non-magnet powered machines by simply rotating the flywheel by hand until the tooling is in the desired position. However, it is difficult to manually cycle magnetically powered machines because the movable magnet cannot easily be moved a precise desired amount.

What is needed is a magnetically powered machine for receiving and operating a terminal applicator, having a cycling mechanism for manually moving the machine ram through its operating range and very precisely positioning the applicator tooling during machine setup.

SUMMARY OF THE INVENTION

A machine is disclosed for receiving and operating a terminal applicator in the attaching of an electrical terminal to a conductor. The machine includes a frame, a magnetic power unit having a fixed portion attached to the frame and a movable portion coupled to the terminal applicator and arranged to move in a power stroke along a first axis for effecting the attachment of the terminal and in a return stroke. A cycling mechanism is provided for moving the movable portion of the magnetic power unit through the power and return strokes. The cycling mechanism includes a feature attached to the movable portion and a latch member. A first coupling is attached to the frame and is coupled to the latch member and arranged to selectively move the latch member in a first direction substantially parallel to the first axis and in a second opposite direction. A means is included for causing the latch member to releasably engage the feature so that when the latch member is moved in the first and second directions the moving portion of the magnetic power unit is moved through its power and the return strokes, respectively.

DESCRIPTION OF THE FIGURES

FIGS. 2 and 3 are front and side views, respectively, of the machine shown in FIG. 1;

FIG. 5 is a cross-sectional view taken along the lines 5—5 in FIG. 1;

FIG. 6 is a cross-sectional view taken along the lines 6—6 in FIG. 2;

FIG. 8 is a view similar to that of FIG. 6 showing a second embodiment of the present invention.

DESCRIPTION OF THE PREFERRED EMBODIMENT

Figure 1:
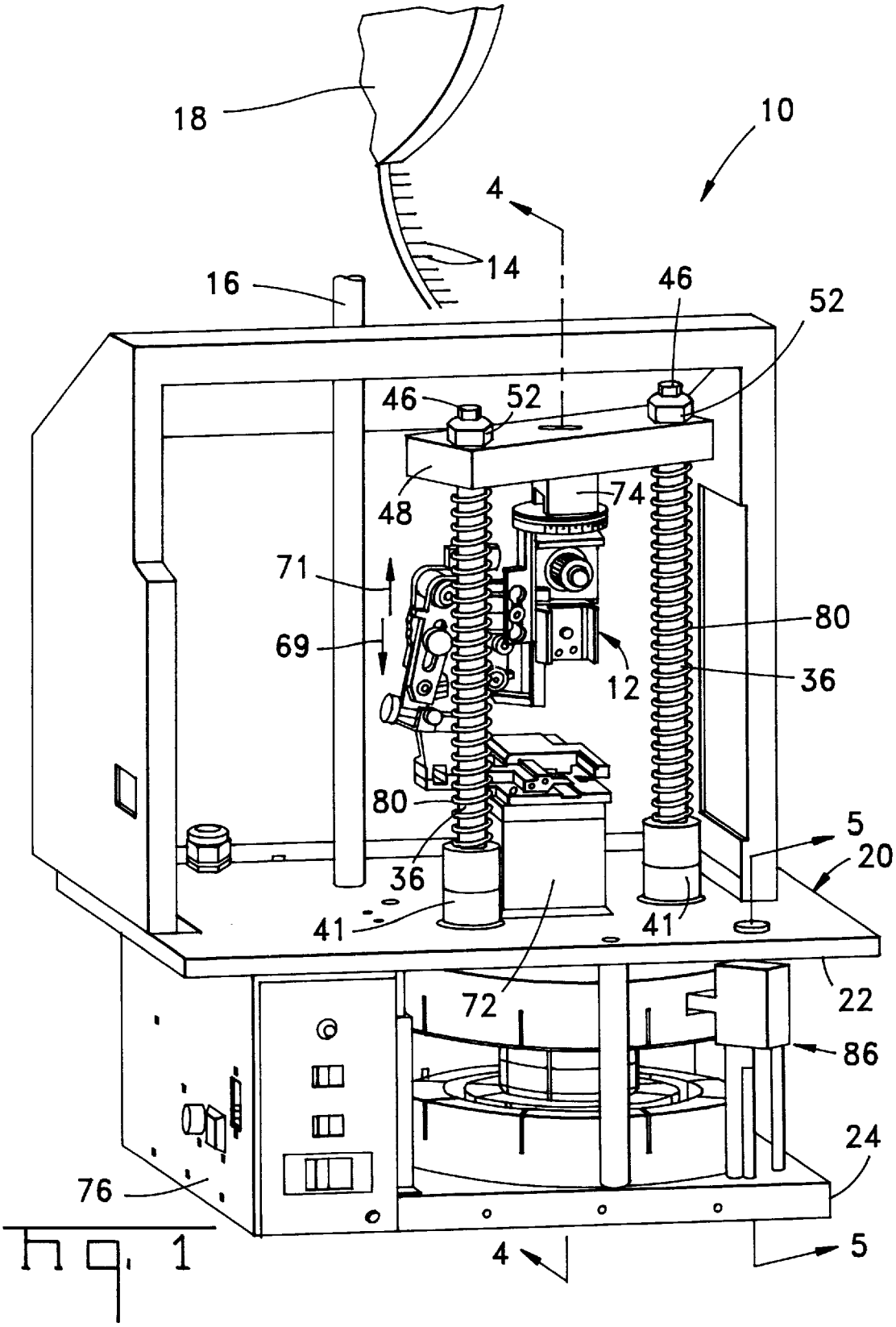
FIG. 1 is an isometric view of a magnetically powered machine incorporating the teachings of the present invention.
Figure 4:
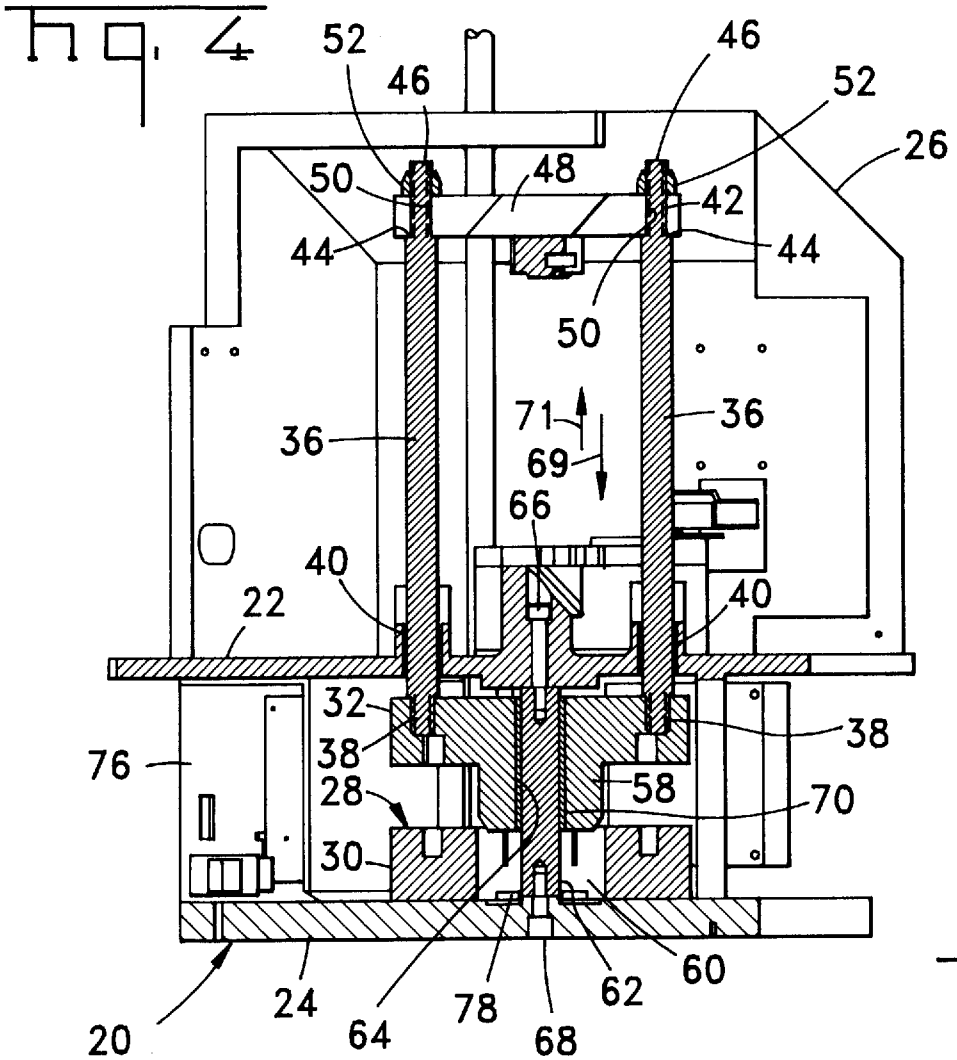
FIG. 4 is a cross-sectional view taken along the lines 4—4 in FIG. 1.

There is shown in FIG. 1 a machine 10 having a terminal applicator 12 coupled thereto for applying electrical terminals 14 to conductors. The machine 10 includes a support member 16 for holding a reel 18 containing a strip of the terminals 14 in the usual manner. The machine 10, shown in FIGS. 2, 3, and 4 without the terminal applicator, has a frame 20 including a top plate 22, a bottom plate 24, and housing covers 26. A magnetic power unit 28 is disposed between the top and bottom plates and includes a lower electromagnet 30 that is attached to the bottom plate and a movable top electromagnet 32. A pair of tension rods 36 having threaded ends 38 tightly threaded into holes in the movable electromagnet 32 are arranged to slide vertically within bushings 40 that are disposed in. bosses 41 in the top plate 22, as best seen in FIG. 4. The other ends of the pair of tension rods 36 each has a reduced diameter 42 forming a shoulder 44 and a threaded end 46. A cross bar 48 having two spaced holes 50 is arranged with the reduced diameters 42 extending through the holes. A pair of nuts 52 are tightly threaded onto the ends 46 so that the cross bar 48 is secured against the two shoulders 44, the holes 50 being spaced to hold the two tension rods 36 mutually parallel. The movable electromagnet 32 includes a nose end 58 which is received in an opening 60 in the lower electromagnet 30. A support post 62 extends through a central bore 64 in the movable electromagnet 32, one end being secured to the top plate 22 by means of a screw 66 and the other end being secured to the bottom plate 24 by means of a screw 68. A bushing 70 is disposed within the bore 64 and is a sliding fit with the support post 62. The bushing 70 which slides along the support post and the two tension rods 36 which slide in the bushings 40 allow the movable electromagnet 32 to freely move vertically, as viewed in FIG. 4, toward and away from the lower electromagnet 30 in the directions of the arrows 69 and 71, respectively. A mounting pedestal 72 extends upwardly from the top plate 22, as best seen in FIG. 1. The terminal applicator 12 is secured to the mounting pedestal in the usual manner. A ram coupling block 74 is attached to and carried by the cross bar 48 and is in coupling engagement with the ram post of the terminal applicator. As the movable electromagnet 32 moves up and down in the directions of the arrows 69 and 71 the ram of the terminal applicator is made to reciprocate along a ram axis 73, shown in FIGS. 2 and 3, during the attaching of the terminals 14. The magnetic power unit 28 is controlled by an electronic controller 76 in the usual manner. In operation, the controller 76 will energize the windings in the upper and lower electromagnets 32 and 30 causing the movable upper electromagnet to move in the direction of the arrow 69 toward the lower electromagnet, carrying the cross bar 48 and coupled applicator ram downwardly as well. Near the bottom of its stroke the nose 58 of the movable electromagnet 32 engages a resilient pad 78 that is within the opening 60 and against the bottom plate 24 which helps to cushion the movable electromagnet as its downward motion is arrested and soften the resulting impact. At this point the controller has de-energized the magnetic power unit. A pair of return springs 80 are disposed between the bosses 41 and the cross bar 48, one tension rod 36 extending through each spring. The springs 80 urge the cross bar 48 upwardly so that the entire movable assembly, including the movable electromagnet 30, tension rods 36, cross bar 48, and terminator ram are urged upwardly in the direction of the arrow 71 to their starting positions ready for the next cycle.

Figure 7:
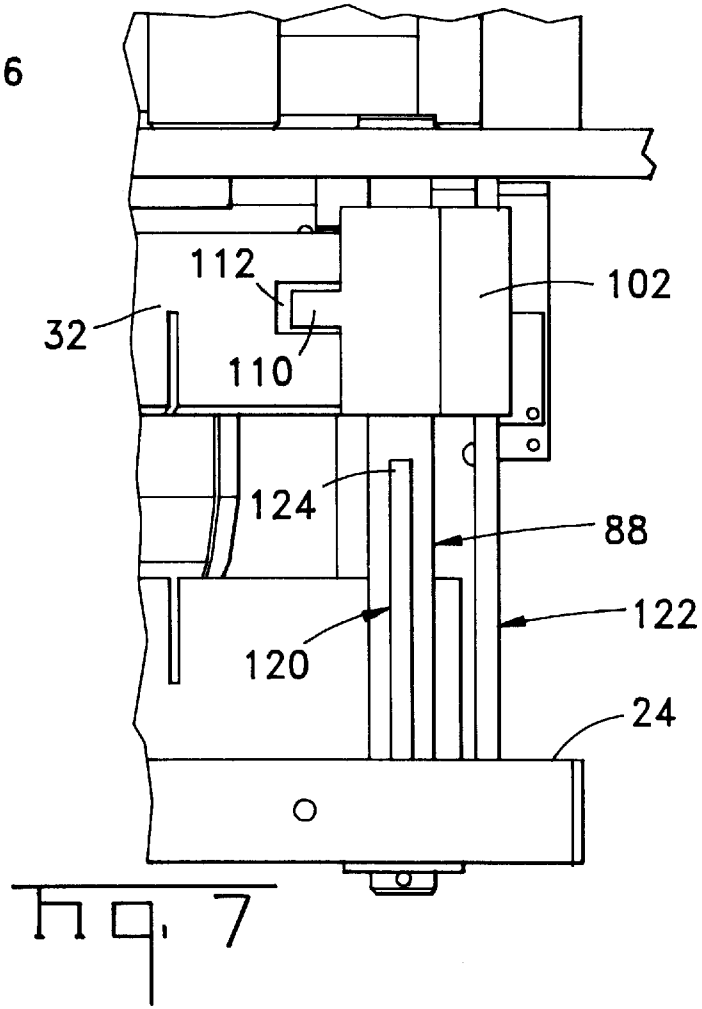
FIG. 7 is an enlarged view of a portion of the machine shown in FIG. 2.

A cycling mechanism 86, as shown in FIGS. 1, 2, and 3, is disposed between the top plate 22 and the bottom plate 24 near the periphery of the magnetic power unit 28. The cycling mechanism 86 includes a lead screw 88 having an end 90 extending through a loose slip fit hole 92 in the bottom plate 24, as best seen in FIG. 5. The lead screw, which is free to turn in the hole 92, is held in place by means of two spring pins 94 arranged in interference fit holes in the lead screw on opposite sides of the bottom plate. A thrust washer 96 is disposed between the lower pin 94 and the lower surface 98 of the bottom plate, as shown, to bear thrust forces in the direction of the arrow 71. There are little or no thrust forces in the opposite direction, the direction indicated by the arrow 69. The lead screw 88 extends through and in threaded engagement with a threaded hole 100 formed through a nut 102, the upper end 104 of the lead screw extending into a loose slip fit hole 106 formed in the top plate 22. A square opening 108 is formed in the end 104, as shown in FIG. 6, for receiving a drive end of a tool, such as a ratchet wrench, for manually rotating the lead screw 88, as will be described. A latch 110 extends outwardly from the nut 102, as shown in FIGS. 5 and 6, and is arranged to be received within an opening 112 formed in a peripheral surface 114 of the movable electromagnet 32. The opening 112 is sized to provide considerable clearance between the walls of the opening and the latch 110 when the movable electromagnet 32 and the nut 102 are in their full up position, as shown in FIGS. 2, 3, and 5. First and second spaced guide pins 120 and 122, each having a threaded end that is tightly threaded into a hole in the bottom plate 24, extend upwardly from the bottom plate parallel to the lead screw 88, as best seen in FIGS. 5, 6, and 7. The first guide pin 120 has a free end 124 that is vertically below the nut 102 when the nut is in its full up position, as shown in FIG. 7, and a first guide surface 126, shown in FIG. 6, running the length of the pin. The second guide pin 122 extends upwardly to the bottom surface of the top plate 22, as shown in FIGS. 5 and 7, and has a second guide surface 128, shown in FIG. 6, running the length of the pin.

During operation of the machine 10, the nut 102 is in its open position shown in solid lines in FIG. 6. During initial set up of the machine, as set forth above, it is desirable to step the ram of the terminal applicator through its entire power and return strokes. This is accomplished by rotating the lead screw 88 in the counterclockwise direction indicated by the arrow 130 in FIG. 6, and then in the opposite direction. The procedure is begun with the nut 102 in its full up position, as shown in FIGS. 2 and 3, so that the nut will rotate along with the lead screw, over the free end 124 of the first guide member 120 until it abuts the second guide surface 122, as shown in phantom lines 132 in FIG. 6. The nut 102 is now in its closed position with the latch 110 positioned within the opening 112. As the lead screw 88 is further rotated counterclockwise the nut 102 and attached latch 110 traverse the lead screw moving the movable electromagnet 32 toward the bottom plate 24 in the direction of the arrow 69. This downward movement continues until the nose 58 abuts against the pad 78, at which time rotation of the lead screw is stopped. The magnetic power unit 28 is then energized by the controller 76 causing the movable electromagnet 32 to move downwardly, against the resilient pad 78, the last small amount into engagement with the lower electromagnet 30. There is sufficient clearance between the opening 112 and the latch 110 to permit this small amount of additional movement without binding. At this point the ram of the terminal applicator 12 is in its fully down position so that its shut height can be measured in the usual manner. The magnetic power unit 28 is then deenergized and the lead screw 88 rotated clockwise in a direction opposite to the arrow 130 shown in FIG. 6. As the nut 102 traverses up the lead screw 88 the latch 110 remains in the opening 112, allowing the movable electromagnet 32 to follow the latch upwardly to its full up position shown in FIG. 5. While the nut 102 is traversing up the lead screw, the side of the nut is in engagement with the first guide surface 126 thereby preventing the nut from rotating the latch 110 out of the opening 112 until very near the full up position where the nut is vertically above the free end 124 of the first guide pin 120. At this point the nut pivots clockwise to its open position shown in solid lines in FIG. 6 with the latch 110 disengaged from the opening 112. During this downward and upward movement of the movable electromagnet 32, and consequently similar movements of the ram of the terminal actuator 16, the various operations of the mechanisms of the terminal applicator can be verified to be functioning correctly.

An alternative structure for the opening 112 is illustrated in FIG. 8. There, an opening 140 is shown in the peripheral surface 114 of the movable electromagnet 32 having a shoulder or abutting surface 142. In operation the lead screw 88 is rotated counterclockwise in the direction of the arrow 130, and the nut 102 pivots counterclockwise until the latch 110 enters the opening 140 and engages the shoulder 142. The latch 110 remains in the opening 140 and against the shoulder 142 while the nut 102 traverses the lead screw downwardly as described above for the opening 112. When the lead screw 88 is rotated in the opposite direction the nut 102 engages the first guide surface 126, thereby preventing the latch 110 from pivoting out of the opening 140 as the nut traverses the lead screw in the direction of the arrow 71. When the nut 102 and the movable electromagnet 32 near their full up positions the nut clears the free end 124 of the first guide pin 120 and it pivots clockwise to the open position shown in phantom lines 144 in FIG. 8. As is apparent, this alternative opening 140 requires only the first guide pin 120, the need for the second guide pin 122 being eliminated by the shoulder 142.

While the latch 110, in the above example, is attached to or is an integral part of the nut 102, other structures may be utilized in the practice of the present invention. Such other structures may include a latch that is pivotally coupled to the nut instead of rigidly attached thereto. In this case the latch may be pivoted into and out of engagement with the opening 112 without pivoting the nut. Another such structure may include a latch that is slidingly coupled to the nut so that it can slide into and out of engagement with the opening 112. Additionally, the opening 112 is only an example of a feature that is associated with the movable magnet 32 that can be engaged by the latch. Other features for engaging the latch may be utilized in the practice of the present invention, such as a projection extending from the movable electromagnet 32 or a combination of a projection and a recess. All of these and similar variations are considered within the scope and spirit of the present invention as described herein.

An important advantage of the present invention is that a magnetically powered machine for receiving and operating a terminal applicator can be manually cycled so that the applicator ram is moved through the power and return strokes of its operating range to verify proper operation of all of the mechanisms of the applicator. Further, the shut height of applicator can be accurately measured and properly adjusted prior to operation. The cycling mechanism is simple to operate and relatively inexpensive to manufacture and maintain.

We claim:

1. In a machine for receiving and operating a terminal applicator in the attaching of an electrical terminal to a conductor, said machine including a frame, a magnetic power unit having a fixed magnetic portion attached to said frame and a movable magnetic portion coupled to said terminal applicator arranged to move in a power stoke along a first axis for effecting said operating thereof and in a return stroke, a cycling mechanism for moving said movable portion through said power and return strokes comprising:

a feature attached to said movable portion;

a latch member;

a first coupling attached to said frame and coupled to said latch member and arranged to selectively move said latch member in a first direction substantially parallel to said first axis under power of said magnetic power unit during said power stroke when said movable magnetic portion is reciprocated relative to said fixed magnetic portion and in a second opposite direction; and means for causing said latch member to releasably engage said feature so that when said latch member is moved in said first and second directions said moving portion of said magnetic power unit is moved through said power and said return strokes, respectively.

2. In a machine for receiving and operating a terminal applicator in the attaching of an electrical terminal to a conductor, said machine including a frame, a magnetic power unit having a fixed portion attached to said frame and a movable portion coupled to said terminal applicator arranged to move in a power stroke along a first axis for effecting said operating thereof and in a return stroke, a cycling mechanism for moving said movable portion through said power and return strokes comprising:

a feature attached to said movable portion;

a latch member;

a first coupling attached to said frame and coupled to said latch member and arranged to selectively move said latch member in a first direction substantially parallel to said first axis and in a second opposite direction;

means for causing said latch member to releasably engage said feature so that when said latch member is moved in said first and second directions said moving portion of said magnetic power unit is moved through said power and said return strokes, respectively;

wherein said first coupling comprises a screw having its longitudinal axis arranged parallel to said first axis and a nut in threaded engagement with said screw, wherein said latch member is coupled to said nut.

3. The machine according to claim 2 wherein said latch member is rigidly attached to said nut.

4. The machine according to claim 2 wherein said latch member includes a threaded hole therethrough that constitutes said nut.

5. The machine according to claim 4 wherein said latch member is pivotable in a third direction about said longitudinal axis of said screw to an engaged position where said latch member is in said engagement with said feature and in a fourth opposite direction to a disengaged position where said latch member is out of said engagement with said feature.

6. The machine according to claim 5 including a first guide surface extending from said frame, said first guide surface arranged to hold said latch member in said engagement with said feature when said latch member is moved in said second direction only until said moveable portion is moved through said return stroke, at which point said latch member is free to pivot in said fourth direction to said disengaged position.

7. The machine according to claim 6 including a second guide surface extending from said frame and spaced from said first guide surface, said second guide surface arranged to hold said latch member in said engagement with said feature when said latch member is moved in said first direction.

8. The machine according to claim 7 wherein said first and second guide surfaces are surfaces of first and second elongated rods, respectively, extending from said frame parallel to said longitudinal axis of said screw, said first rod extends a first distance from said frame and said second rod extends a second distance from said frame that is greater than said first distance.

9. The machine according to claim 8 wherein said first distance is such that said latch member is in abutting engagement with said first surface thereby holding said latch member in said engagement with said feature when said movable member is moved through said return stroke and upon completion of said movement through said return stroke said latch member is spaced from said first surface.

10. The machine according to claim 6 wherein said feature is an opening in a peripheral surface of said movable portion.

11. The machine according to claim 10 wherein said opening includes an abutting wall for limiting said pivotal movement in said third direction of said latch member and holding said latch member in said engagement with said feature when said latch member is moved in said first direction.

12. The machine according to claim 11 wherein said first surface extends from said frame a first distance such that said latch member is in abutting engagement with said first surface thereby holding said latch member in said opening when said movable member is moved through said return stroke and upon completion of said movement through said return stroke said latch member is spaced from said first surface and is free to pivot in said fourth direction to said disengaged position.

* * * * *